US008864199B2

(12) United States Patent
Cook

(10) Patent No.: US 8,864,199 B2
(45) Date of Patent: Oct. 21, 2014

(54) MAIL BOX OPENER

(76) Inventor: Timothy Edward Cook, Manchester, GA (US)

( * ) Notice: Subject to any disclaimer, the term of this patent is extended or adjusted under 35 U.S.C. 154(b) by 0 days.

(21) Appl. No.: 13/603,362

(22) Filed: Sep. 4, 2012

(65) Prior Publication Data

US 2014/0097628 A1 Apr. 10, 2014

(51) Int. Cl.
*B65G 7/12* (2006.01)

(52) U.S. Cl.
USPC ..... 294/25

(58) Field of Classification Search
CPC ..... B01D 2255/20707; B01D 2255/20776; B01D 2255/802; B01D 2259/802; B01D 2259/804; B65G 7/12; A01K 97/14; A61F 13/105; E01H 1/1206; A45F 5/02; A45F 5/00; A45F 2200/0516; A45F 5/021; A45F 2005/008; A44C 9/00; A44C 17/02; A44C 17/04; A44C 17/0208; A44C 27/00; A47G 29/1209; A47G 29/12; A47G 29/1216; A47G 29/1203; A47G 29/121; A47G 25/902; F16M 11/10; F16M 13/00; F16M 13/02; F16M 11/00; F21L 15/08
USPC ..... 294/3.6, 25–26, 215, 219; 224/217, 224/218, 197, 930; 63/1.12, 15; 232/17, 45, 232/46; 43/4; 248/682, 688; 206/320; 16/421
See application file for complete search history.

(56) References Cited

U.S. PATENT DOCUMENTS

| | | | | | |
|---|---|---|---|---|---|
| D410,212 | S | * | 5/1999 | Otero | D11/26 |
| D516,218 | S | * | 2/2006 | Larocca | D24/190 |
| D530,427 | S | * | 10/2006 | LaRocca | D24/190 |
| D569,513 | S | * | 5/2008 | Poll et al. | D24/143 |
| D669,390 | S | * | 10/2012 | Wang | D11/99 |
| 2008/0034791 | A1 | * | 2/2008 | Arcadi | 63/15 |

* cited by examiner

*Primary Examiner* — Stephen Vu
(74) *Attorney, Agent, or Firm* — Jason A. Bernstein; Barnes & Thornburg LLP

(57) ABSTRACT

A device allows mail carriers to open and close mail boxes without having to touch the receptacle directly. The device includes a ring portion that the mail carrier can attach to their finger. An engager portion can engage a mail box door handle while wings on each side of the engager portion and stabilize the device while it is used to open and close the mail box.

1 Claim, 6 Drawing Sheets

MAIL BOX OPENER

BACKGROUND OF THE INVENTION

The present invention relates to a mail box opener and, more particularly, to mail box opener that allows mail carriers to open mail boxes without the need to touch the receptacle.

Mail carriers' hands and fingers are punished by the hundreds of mail boxes they open and close on their routes as they reach from inside their vehicles to deposit mail in various receptacles.

Some mailboxes can be rusted and can include torn and/or broken metal or plastic parts that can injure a mail carrier's hand or fingers when trying to open or close mail boxes.

As can be seen, there is a need for a device to allow a mail carrier to open and close mail boxes safely and easily while minimizing direct contact between the mail carrier's hand and fingers and the mail box receptacle.

SUMMARY OF THE INVENTION

In one aspect of the present invention, a mail box opener comprises a ring-shaped base portion operable to fit on a finger of a user; an engager disposed on the ring-shaped base portion, the engager operable to open a mail box; and stabilizer wings disposed on and extending from sides of the ring-shaped base portion, the stabilizer wings disposed between the engager and the ring-shaped base portion.

In another aspect of the present invention, a method for opening and closing mailboxes comprises placing a mail box opener on one finger, the mail box opener including a ring-shaped base portion operable to fit on a finger of a user, an engager disposed on the ring-shaped base portion, and stabilizer wings disposed on and extending from sides of the ring-shaped base portion, the stabilizer wings disposed between the engager and the ring-shaped base portion, the engager disposed away from a palm side of a user's hand; engaging the engager with a mail box lid; pulling to open the mail box lid with the engager; and pushing the mail box lid closed with the engager.

In a further aspect of the present invention, a mail box opener comprises a ring-shaped base portion operable to fit on a finger of a user; an engager disposed on the ring-shaped base portion, the engager operable to open a mail box; stabilizer wings disposed on and extending from sides of the ring-shaped base portion, the stabilizer wings disposed between the engager and the ring-shaped base portion; a post extending from the ring-shaped base portion, through the stabilizer wings, to the engager; and an indented portion formed in the engager, the indented portion providing two points along an outer edge of the engager.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device that allows mail carriers to open and close mail boxes without having to touch the receptacle directly. The device includes a ring portion that the mail carrier can attach to their finger. An engager portion can engage a mail box door handle while wings on each side of the engager portion and stabilize the device while it is used to open and close the mail box.

Figure 1:
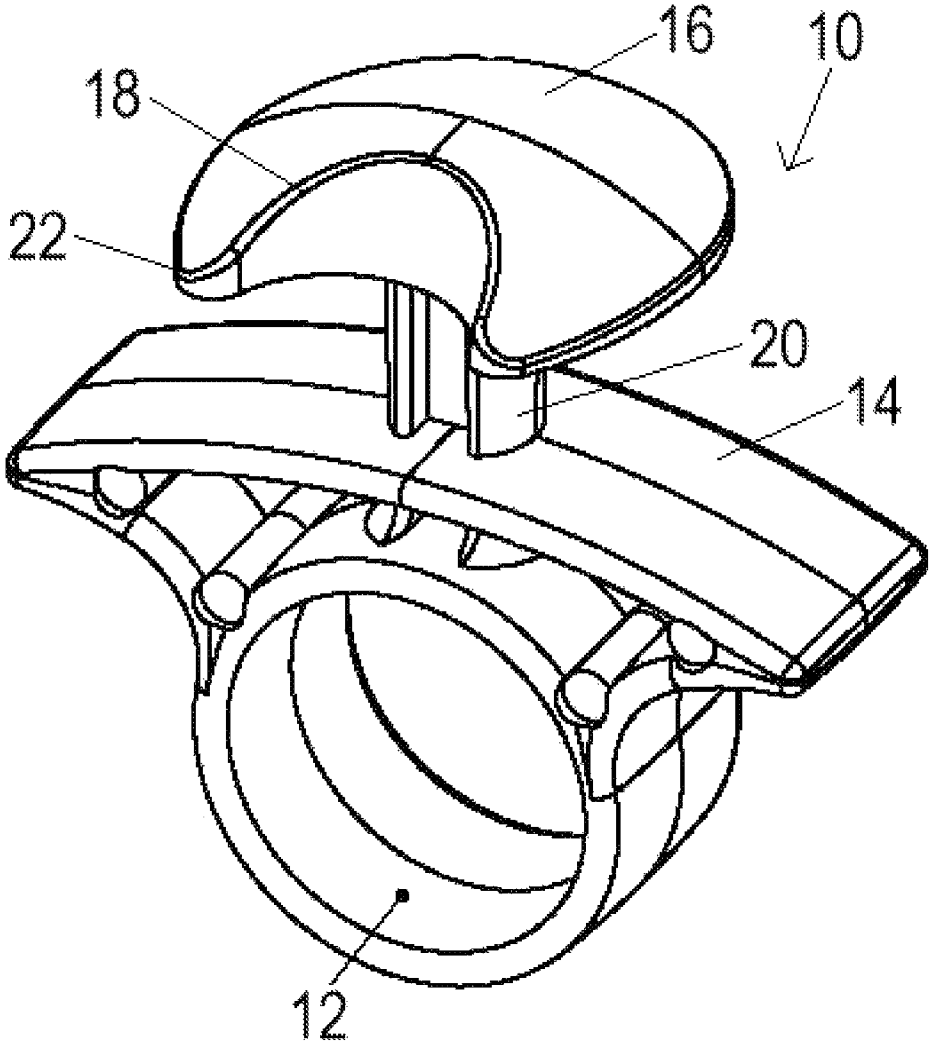
FIG. 1 is a perspective view of a mail box opener according to an exemplary embodiment of the present invention.
Figure 2:
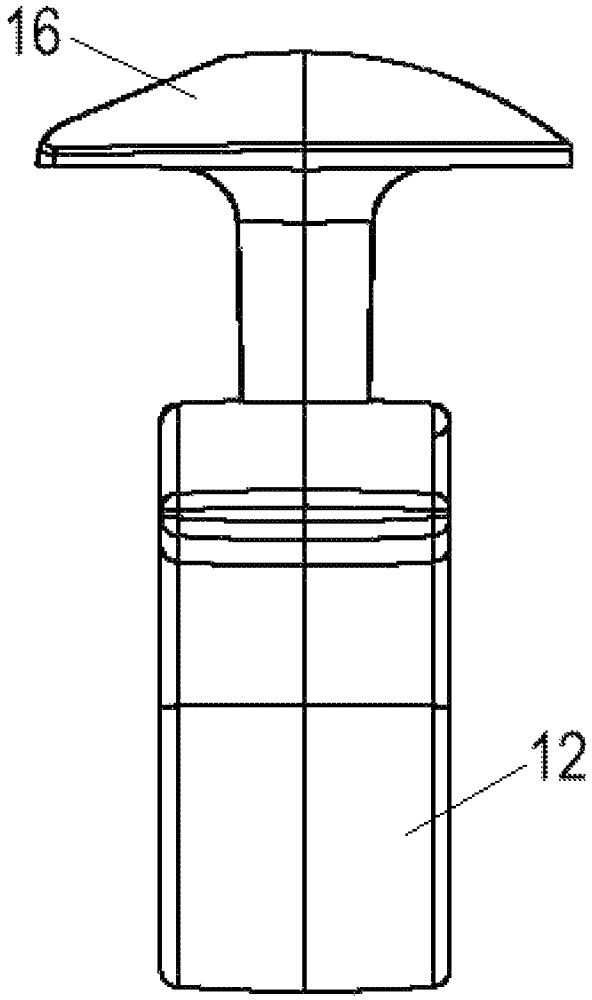
FIG. 2 is a side view of the mail box opener of FIG. 1.
Figure 3:
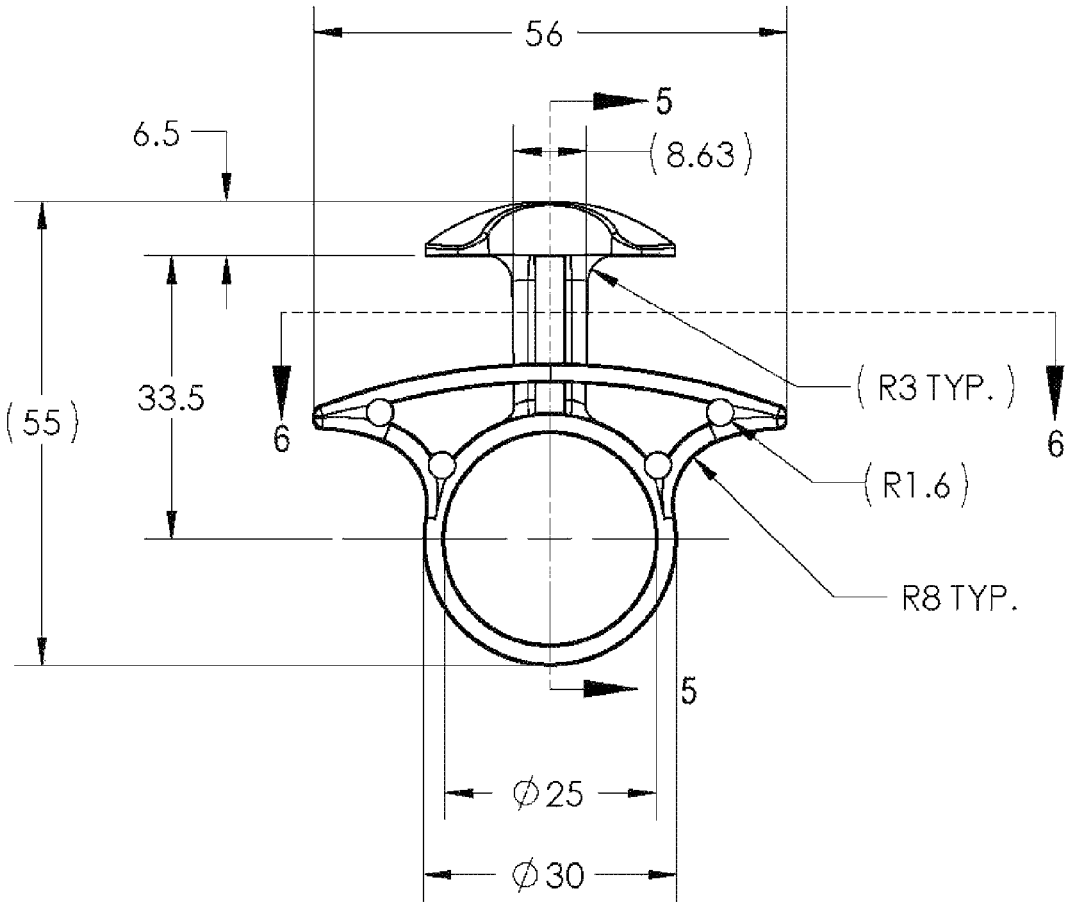
FIG. 3 is a front view of the mail box opener of FIG. 1.
Figure 4:
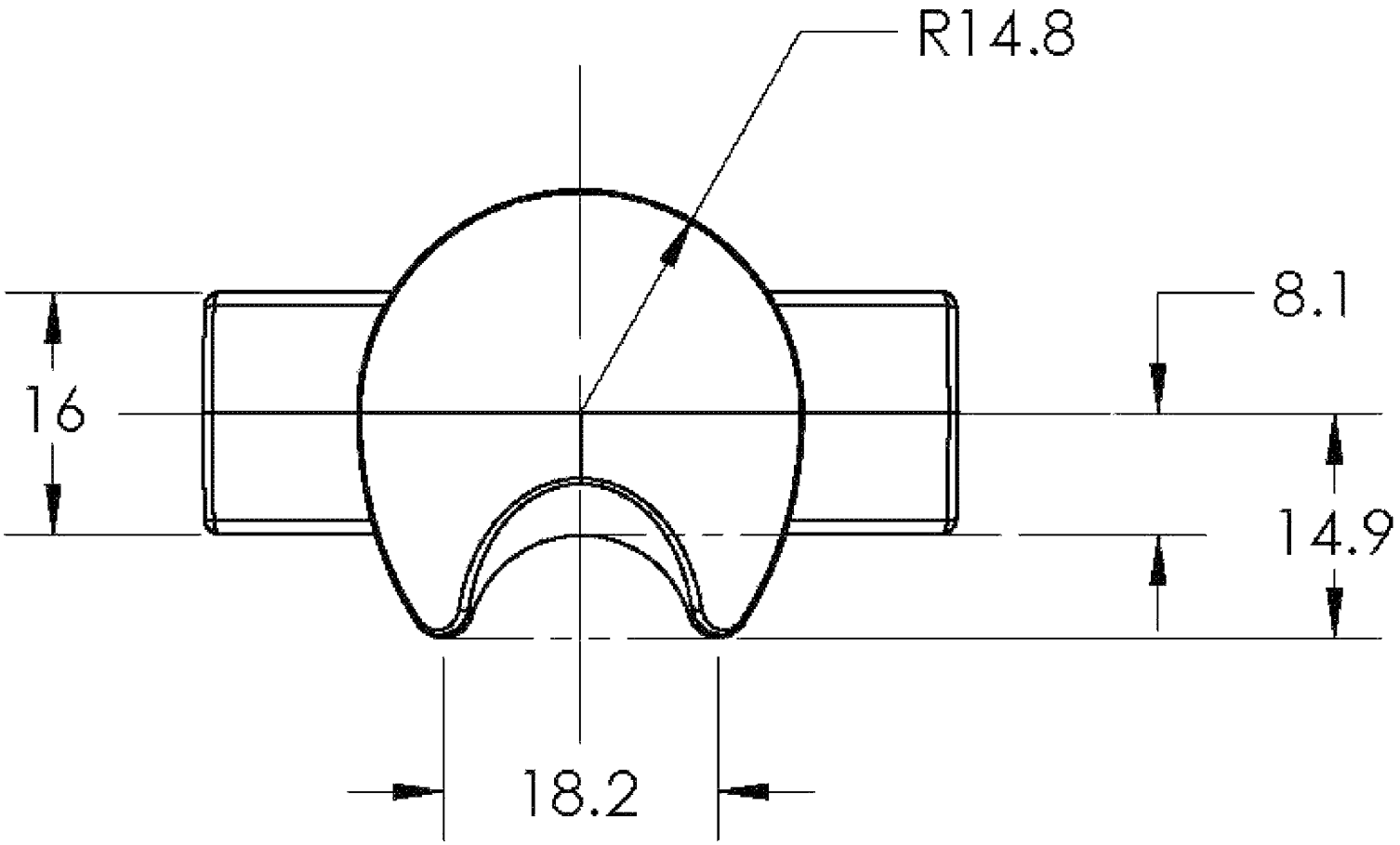
FIG. 4 is a top view of the mail box opener of FIG. 1.
Figure 5:
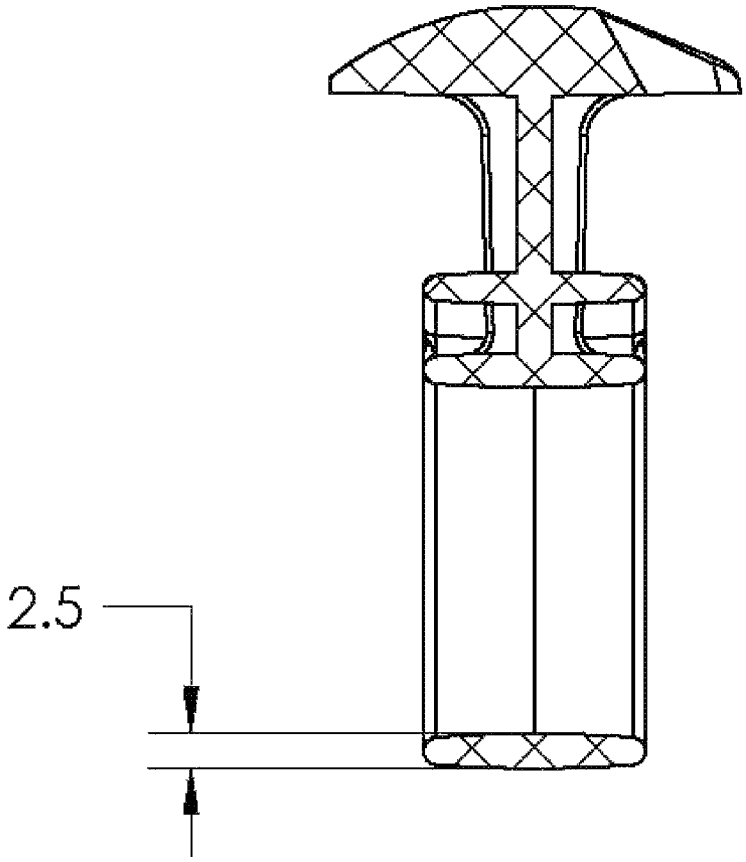
FIG. 5 is a cross-sectional view taken along line 5-5 of FIG. 3.
Figure 6:
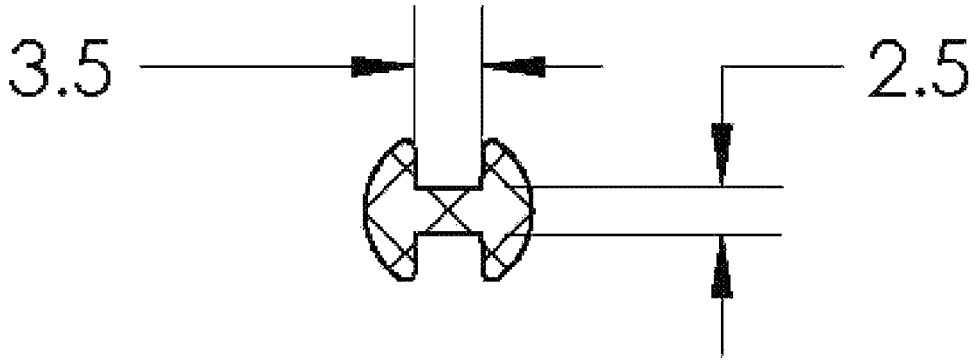
FIG. 6 is a cross-sectional view taken along line 6-6 of FIG. 3.

Referring now to FIGS. 1 through 6, a mail box opener 10 can include a ring-shaped base portion 12 operable to fit on a finger of a user. The ring-shaped base portion 12 can be made in various sizes to comfortably fit on various user's fingers. The mail box opener 10 can be designed to fit on various fingers of the user, depending on their preference. The ring-shaped portion 12 can be made of a rigid material or a flexible material and can include rounded edges and/or optional padding for comfort. The ring-shaped base portion can be made in various widths, typically from about 10 to about 20 mm in width, as wider widths may provide additional comfort to the user.

Wings 14 may be attached to and extend from the ring-shaped base portion 12. The wings 14 may extend beyond the width of the ring-shaped base portion 12. A post 20 may extend from the ring-shaped base portion 12 and through the wings 14.

The post 20 can support an engager 16. The engager 16 may be sized and shaped to easily engage a mail box lid to open and close the mail box. In some embodiments, the engager 16 can include an indented portion 18 creating two points 22 on one side of the engager 16. The points 22 may be helpful for engaging the mail box lid.

To use the mail box opener 10, the user can place the device on the chosen finger and reach out, with mail in hand, to deposit the mail. The post 20 and the engager 16 are positioned at the proper distance so as to reach the receptacle before the hand. The engager 16 can grasp the lid/door/knob of the receptacle while being stabilized by the wings 14 and, with a pull, the receptacle is opened, mail deposited, and the lid/door/knob is closed with the device.

With the mail box opener 10 of the present invention, actions that would normally require one to touch the metal, wood or plastic twice can be accomplished with no touch. Therefore, the risks of cuts, abrasions, and contact with undesirable material is eliminated.

The mail box opener 10 of the present invention can be made from various materials, including plastic, metal, composite, or the like. Typically, the mail box opener 10 can be made of a plastic material by, for example, low volume injection molding.

FIGS. 3 through 6 show exemplary dimensions of the mail box opener 10 of the present invention. It should be noted that other sizes and relative dimensions are contemplated within the scope of the present invention.

While the above describes using the device of the present invention for opening and closing mail boxes, the device can be used for various other functions. The device can be useful for anyone who uses their hands and fingers to push and grasp while holding another object or objects, for example.

It should be understood, of course, that the foregoing relates to exemplary embodiments of the invention and that modifications may be made without departing from the spirit and scope of the invention as set forth in the following claims.

What is claimed is:

1. A mail box opener comprising:

(a) a ring-shaped base portion operable to fit on a finger of a user;

(b) a post extending from the base portion;

(c) an engager associated with the post, the engager comprising a head having a generally dome-shaped upper surface, a generally flat lower surface, a generally circular peripheral edge, a portion of the peripheral edge having an indented cutout portion extending into the peripheral edge of the head from the upper surface to the lower surface, the cutout portion including at least one point adapted to engage a mailbox lid; and, (d) first and second stabilizer wings extending laterally from the post and between the base portion and the engager, each of the stabilizer wings having a generally straight first side and a generally straight second side, the first and second sides being generally parallel to each other, each of the stabilizer wings further including a brace portion associated with an underside of each of the stabilizer wings and with the base portion, the first stabilizer wing being generally opposite to the second stabilizer wing.

* * * * *